United States Patent [19]

Williams, III et al.

[11] Patent Number: 4,595,420

[45] Date of Patent: Jun. 17, 1986

[54] METHOD AND APPARATUS FOR CLEANING AND MAINTAINING CARPET

[76] Inventors: Robert C. Williams, III, 11309 Derby Dr., Raleigh, N.C. 27612; Stephen R. Williams, 304 Howland Dr., Cary, N.C. 27511; Robert R. Weil, 11613 Coachmans Way, Raleigh, N.C. 27614

[21] Appl. No.: 666,120

[22] Filed: Oct. 29, 1984

[51] Int. Cl.[4] ..... B08B 5/04

[52] U.S. Cl. ..... 134/6; 134/21; 134/30; 134/37; 15/320; 15/353

[58] Field of Search ..... 134/6, 10, 21, 26, 30, 134/37; 15/320, 321, 345, 346, 347, 353, 363

[56] References Cited

U.S. PATENT DOCUMENTS

| | | | |
|---|---|---|---|
| 3,959,010 | 5/1976 | Thompson et al. | 15/320 |
| 3,964,924 | 6/1976 | Burgoon | 134/21 |
| 4,353,145 | 10/1982 | Woodford | 15/320 |
| 4,464,810 | 8/1984 | Karpanty | 15/320 |

*Primary Examiner*—Richard V. Fisher
*Assistant Examiner*—Sharon T. Cohen
*Attorney, Agent, or Firm*—Mills and Coats

[57] ABSTRACT

The present invention entails a method and apparatus for cleaning and maintaining large areas of low to medium pile carpet, such as is found in hotels, airports, etc. The invention employs a mobile carpet cleaning machine which is propelled over the carpet to be cleaned. The principal features of the carpet cleaning machine are an elongated cylindrical brush, a vacuum system with a floating vacuum head, and a blower. In operation the cylindrical brush is set into a rotating motion and engages the underlying carpet. A cleaning solution is sprayed onto the rotating brush which in turn transfers the solution onto the underlying carpet. The vacuum head then passes over the carpet directly behind the rotating brush. The blower pulls air through the vacuum head and the vacuum head effectively picks up a combined mixture of air and solution. This mixture of air and solution is pulled upwardly from the vacuum head into the top of a recovery tank. Once the mixture enters the tank, the solution falls out and the air is induced up into a tube where the air is then directed to the blower. Once in the blower, the air is heated and directed back down onto the carpet through an outlet located directly behind the vacuum head for the purpose of drying the carpet. Thus the entire cleaning operation requires only one pass over the carpet.

24 Claims, 8 Drawing Figures

METHOD AND APPARATUS FOR CLEANING AND MAINTAINING CARPET

BACKGROUND OF INVENTION

Traditionally, the predominant use of carpets has been in homes, offices and other private or semi-private areas. The carpets used in these areas are often luxurious carpets with high piles. Therefore, a deep cleaning process is necessary to remove dirt from this type of carpet. However, due to the light traffic these carpets normally receive, deep cleaning is needed only every few months.

Advancements in materials in recent years has led to the development of rugged low pile carpets which are suitable for use in heavily trafficed areas. These carpets are now frequently found in airports, hotels and other commercial and industrial areas. Due to the construction of these carpets and the high degree of traffic these carpets receive an entirely different method of cleaning and maintaining these carpets is necessary.

Because of the heavy traffic received by commercial low pile carpets, there is considerable build up of dirt and stains daily. Therefore, these carpets need a method of cleaning which can be used daily. However, there is a desire not to inconvenience the public by closing off large areas at a time for cleaning. Therefore, there is a need for a carpet cleaning machine that emphasizes "maintenance" and which can be used to economically clean low to medium pile carpets on a daily basis and which is fast and efficient so that commercial areas need not be closed for prolonged periods during cleaning.

SUMMARY AND OBJECTS OF INVENTION

The present invention presents a fast and efficient method and apparatus for cleaning and maintaining low to medium pile commercial type carpets which is suitable for use on a daily basis. In particular, the invention employs a carpet cleaning machine which cleans and dries a carpet as the machine is propelled over the same. The machine uses an elongated cylindrical brush which rotates as the machine is propelled over a carpet. A cleaning solution is sprayed onto the brush which in turn transfers the solution onto the carpet. A vacuum head passes over the carpet directly behind the brush. A blower pulls air through the vacuum head effectively lifting a combined mixture of air and solution from the carpet. The mixture is pulled upwardly into a recovery tank where the air and solution are separated. The air is then heated and directed back down onto the carpet for drying the same.

Of particular significance to the present invention is the fact that the vacuum head is particularly designed so as to move up and down in response to undulations in the underlying carpet. This allows the head to maintain maximum contact with the underlying carpet resulting in more efficient removal of dirt and cleaning solution from the carpet.

It is therefore an object of the present invention is to provide a carpet cleaning machine that can clean and dry in one pass over the carpet so as to minimize the time needed to clean a large area of carpet.

It is also an object of the present invention to provide a carpet cleaning machine having means for regulating the flow of cleaning solution so that the operator can maximize cleaning and minimize drying time on various types of carpets.

A further object of the present invention resides in the provision of a carpet cleaning machine wherein the rotating motion of the brush helps to propel the carpet cleaning machine so that the operator is aided, thereby reducing operator fatigue and increasing worker productivity levels.

Still a further object of the present invention is to provide a starting means for the carpet cleaning machine which allows the electric motor to overcome its own torque requirements prior to encountering any load in driving the brush.

Also an object of the present invention is to provide a carpet cleaning machine which can use a conventional 115 volt grounded outlet.

Yet another object of the present invention is to provide a carpet cleaning machine in which the controls are designed to accommodate any size operator.

Other objects and advantages of the present invention will become apparent from the following description and accompanying drawings.

DESCRIPTION OF INVENTION

Figure 1:
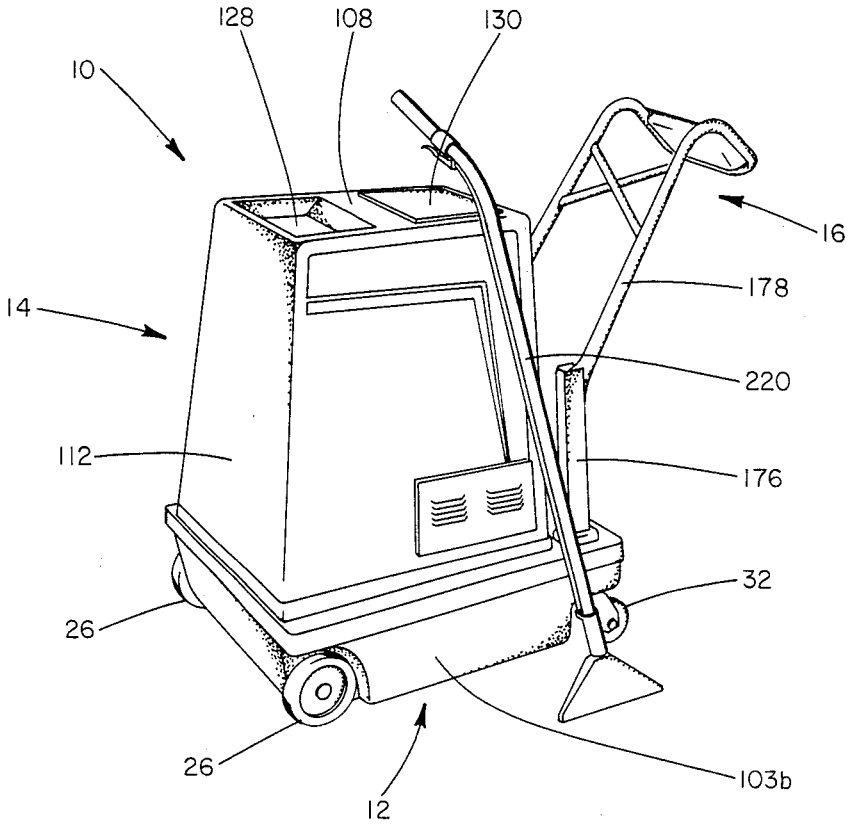
FIG. 1 is a perspective view of the carpet cleaning machine of the present invention.

With further reference to the drawings, the apparatus of the present invention for cleaning and maintaining low pile carpets is shown therein and indicated generally by the numeral 10.

Viewing carpet cleaning machine 10 in more detail it is seen that the same includes an undercarriage 12, an upper frame structure 14, and a handle assembly 16.

Figure 2:
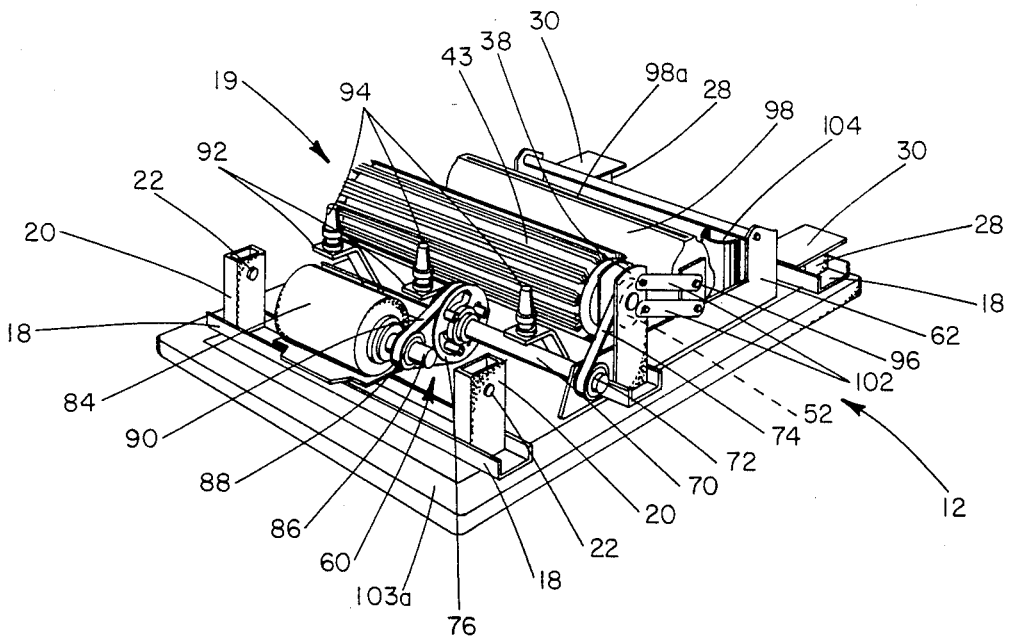
FIG. 2 is an inverted perspective view of the undercarriage cleaning assembly of the carpet cleaning machine.

The principal structure of undercarriage 12 is a rectangular chasis 18 and a cleaning assembly indicated generally by the numeral 19 (FIG. 2). Chasis 18 includes front wheel mounts 20 which are formed out of a rectangular tube. Wheel bushings 22 are provided in holes which are drilled laterally through front wheel mounts 20. Front wheels 26 are mounted on each wheel mount 20. Chasis 18 also includes rear wheel mounts 28. Rear wheel mounts 28 include a mounting plate 30 containing mounting holes drilled therein. Rear casters 32 are mounted to and underneath mounting plate 30.

Chasis 18 further includes a pair of laterally spaced brush mounts 38. Brush mounts 38 are positioned approximately midway between front wheel mounts 20 and rear wheel mounts 28. Brush mounts 38 are also formed from rectangular tubes. However, one side of the rectangular tube forming the brush mount 38 shown in FIG. 2 is open.

An elongated cylindrical brush 43 is rotatively mounted between brush mounts 38. Brush 43 is composed of a thick wall plastic tube 43*a* and bristles 43*b* which are attached to plastic tube 43*a* in rows. Pin holes 44 are drilled 180 degrees apart into each end of plastic tube 43*a* forming brush 43.

Figure 6:
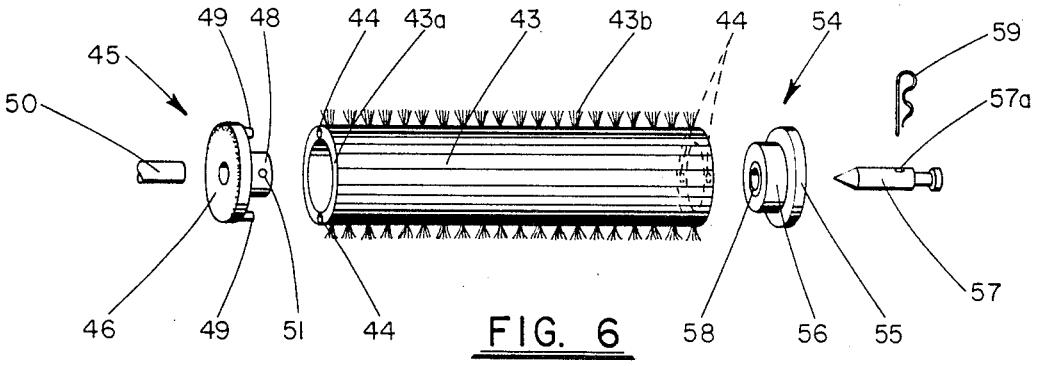
FIG. 6 is an exploded view of the brush and brush assembly of the carpet cleaning machine.

One end of brush 43 is rotatively mounted to a respective brush mount 38 by means of a brush drive block 45 (See FIG. 6). Drive block 45 is composed two concentric parts which are, from largest to smallest, a drive plate 46, and a mounting sleeve 48. The diameter of drive plate 46 is roughly equivalent to the outside diameter of plastic tube 43*a* forming brush 43. Drive plate 45 can be inserted into one end of brush 43 until drive plate 46 contacts the thick wall of plastic tube 43*a*. Drive block 45 further includes a pair of drive pins 49 which are mounted 180 degrees apart on drive plate 46. Thus, the drive pins 49 will extend through the pin holes 44 in brush 43 as drive block 45 is inserted into one end.

Drive block 45 is then mounted on the end of a drive shaft 50 which extends through drive block 45 along the axis of all the concentric parts. Drive block 45 is secured to drive shaft 50 by threaded set screw 51 which are drilled radially into sleeve 48, and screwing set screw 51 until fimrly contacting drive shaft 50. It is appreciated that brush 43 must be removed from drive block in order to tighten set screw 51. Drive block 45 and drive shaft 50 are then rotatively mounted to the brush mount 38 (Shown in FIG. 2) by inserting a drive pulley 52 into the rectangular tube forming the brush mount through its one open side. Drive shaft 50 is then inserted through brush mount 38 so as to be rotatively journaled therein. In the process of inserting drive shaft 50 through brush mount 38, the drive shaft 50 will also be inserted through drive pulley 52 so that the same is mounted on drive shaft 50 within brush mount 38. A set screw (not shown) on drive pulley 52 can be tightened against drive shaft 50 securing drive pulley 52 to the drive shaft 50.

The other end of brush 43 is rotatively mounted to a second brush mount 38 by means of a brush end plate 54 (See FIG. 6). Brush end plate 54 includes a cover plate 55 and a smaller concentric hub 56. The diameter of cover plate 55 is roughly equivalent to the outside diameter of plastic tube 43*a* forming brush 43 while the diameter of hub 56 is slightly less than the inside diameter of plastic tube 43*a* forming brush 43. Thus, end plate 54 can be inserted into the end of brush 43 until cover plate 55 contacts the thick wall of plastic tube 43*a*. Note that unlike drive block 45, end plate 54 does not have drive pins.

End plate 54 is rotatively mounted to brush mount 38 on a brush pin 57. Brush pin 57 is inserted from the outside of brush mount 38 through a brush pin bearing 58 which is disposed in plate 54. Brush pin 57 is particularly designed to hold end plate 54 a predetermined distance from brush mount 38. Therefore, a retaining pin 59 can be inserted through a retaining pin hole 57*a* in brush pin 57 at a point between brush mount 38 and end plate 54 thereby preventing brush pin 50 from withdrawing while carpet cleaning machine 10 is in use.

From the foregoing discussion it is appreciated that brush 43 can be easily removed from carpet cleaning machine 10 by removing retaining pin 59 and brush pin 57 in that order. Brush 43 can then be lifted off drive block 45. And because pin holes 44 are drilled into each end of brush 43, the same can be reversed when it is reinstalled to prevent the bristles 43*b* from being inclinded in one direction.

Figure 7:
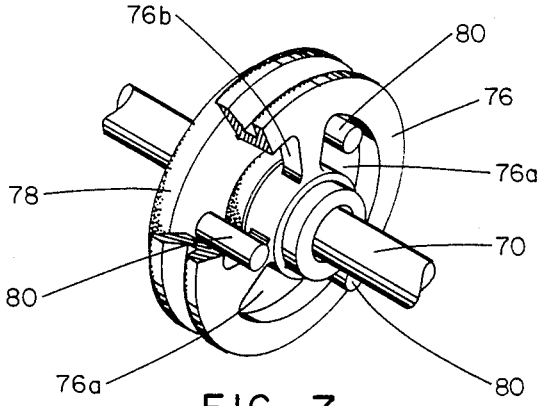
FIG. 7 is a fragmentary perspective view of the impact starter assembly of the carpet cleaning machine.

An impact starter assembly indicated generally by the numeral 60 is mounted adjacent to brush 43 (See FIGS. 2 and 7). Impact starter assembly 60 includes a jack shaft mount 62 which is actually part of chasis 18. Jack shaft mount 62 is fashioned from a pair of laterally spaced upstanding steel plates. Impact starter assembly 60 also includes a jack shaft 70 which extends between the upstanding steel plates. A jack shaft pulley 72 is keyed to one end of jack shaft 70 and is aligned with brush drive pulley 52. A brush drive belt 74 extends through the open side of brush mount 38 and operatively interconnects jack shaft pulley 72 and brush drive pulley 52. Impact starter assembly 60 further includes a drive pulley 76 which is rotatively journaled about the opposite end of jack shaft 70 and drive plate 78 which is keyed to jack shaft 70 adjacent to drive pulley 76. At least one stud 80 extends from drive plate 78 through openings 76*a* formed in drive pulley 76. It is appreciated that opening 76*a* is so formed as to allow drive sheave 76 to freely rotate about jack shaft 70 part of a turn prior to the moment of impact between stud 80 and the edge or wall 76*b* of opening 76*a*.

An electric motor 84 is also mounted to chasis 18 and is disposed adjacent to impact starter assembly 60. Motor shaft 86 extends outwardly from electric motor 84. Clutch pulley 88 is keyed to motor shaft 86 and is aligned with pulley or sheave 76. Belt 90 operatively interconnects clutch pulley 88 and sheave 76.

It is appreciated that when power is supplied to electric motor 84 the same rotates clutch pulley 88 driving belt 90. Belt 90 drives pulley 76 which will rotate freely on jack shaft 70 until the edge or wall 76*b* of opening 76*a* engages stud 80 of drive plate 78. Once engaged, drive pulley 76 rotates drive plate 78 which in turn rotates jack shaft 70. Jack shaft pulley 72 rotates with jack shaft 70 driving brush drive belt 74 which in turn drives brush 43.

Chasis 18 further includes three jet mounts 92 which are laterally spaced across chasis 18 adjacent to brush 43. A jet 94 is mounted on each jet mount 92 and is directed toward brush 44.

A vacuum head 96 is mounted to chasis 18 directly behind brush 43. Vacuum head 96 includes an elongated manifold 98 with and elongated slot 98*a* therein and a vacuum hose coupling 100. A parallel bar linkage 102 pivotably connects each end of vacuum head 96 to brush mounts 38 such that vacuum head 96 can freely move up and down in response to undulations in an underlying carpet.

Figure 8:
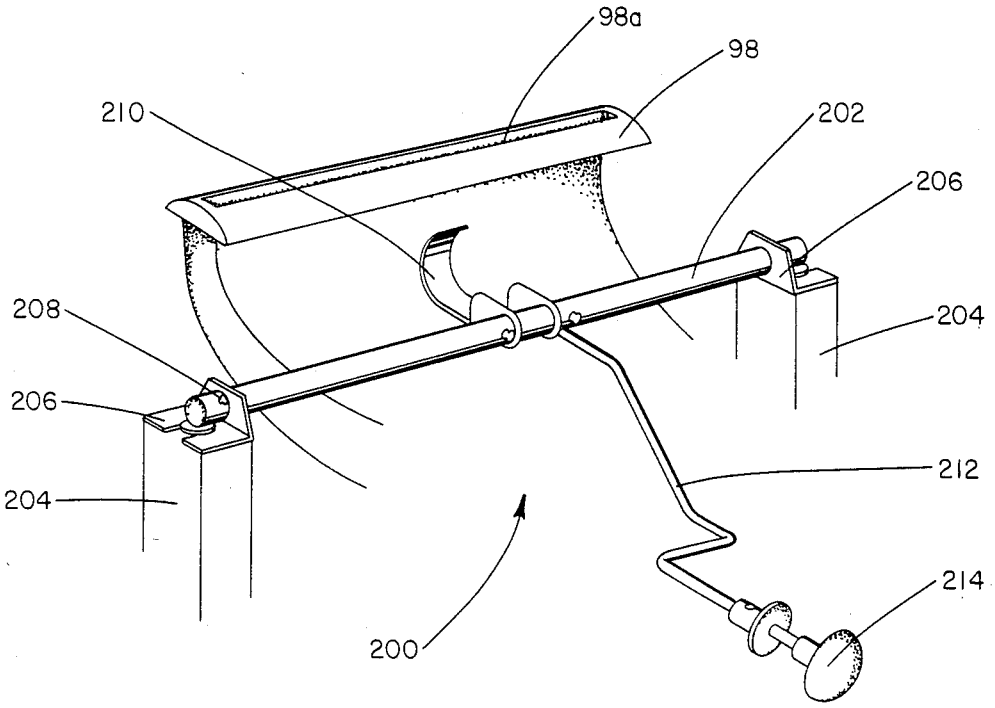
FIG. 8 is a perspective view of a lift mechanism of the carpet cleaning machine.

A lift mechanism indicated generally by the numeral 200 is associated with vacuum head 96 for lifting the same while carpet cleaning machine 10 is pushed through doorways, etc., to prevent damage to vacuum head 96 (See FIG. 8). Lift mechanism 200 includes a lift rod 202 which extends across chasis 18 underneath vacuum head 96. Lift rod 202 is mounted to a pair of lift rod mounts 204, which are part of chasis 18, by a pair of mounting plates. Rod mounting plates 206 are attached to each rod mount 204 by a bolt which extends through mounting plate 206 and screws into a threaded hole until mounting plate 206 is firmly stationed on rod mount 204. Lift rod 202 extends between mounting plates 206. Lift rod 202 is held in place by inserting two retaining pins 208 into holes (not shown) drilled through each end of lift rod 202. A cam 210 is attached to lift rod 202 underneath vacuum head 96. When cam 210 is turned the same engages the underside of vacuum head 96 pushing it upward. A flexible shaft 212 is attached to cam 210 for turning the same. Flexible shaft 212 extends out the back of carpet cleaning machine 10 and has a knob 214 on the end. When knob 214 is pulled out, cam 210 is turned causing the same to engage and lift vacuum head 96.

Undercarriage 12 further includes an upper base cover 103*a* and a lower side base cover 103*b*. Upper base cover 103*a* mounts on top of chasis 18 and includes a drying outlet 104 which extends through chasis 18 directly behind vacuum head 96. A hose coupling (not shown) is attached to drying outlet 104.

Upper frame structure 14 mounts on top of undercarriage 12 and particularly to chasis 18. Upper frame structure 14 is comprised of a shell structure having a top 108, two side walls 110, a front wall 112, and a rear wall 114. Upper frame structure 14 is compartmentalized by partition wall 116, and bottoms 118, and 120 into a supply tank 122, a recovery tank 124, and a mechanical compartment 126 (See FIG. 3). Supply tank 122 and recovery tank 124 are disposed within the upper portion of upper frame structure 14 and are separated by partition wall 116. The supply tank 122 occupies the front of upper frame structure 14 while the recovery tank 124 occupies the rear of upper frame structure 14. Mechanical compartment 126 extends across the lower portion of upper frame structure 14 underneath both the supply tank 122 and the recovery tank 124. Mechanical compartment 126 is separated from supply tank 122 by bottom 118 and from recovery tank 124 by bottom 120.

Viewing upper frame structure 14 externally it is seen that the same includes a variety of openings into various areas of upper frame structure 14. Two such openings are seen in the top 108 of upper frame structure 14. Filler opening 128 extends through top 108 into supply tank 122. An access opening extends through the top 108 into recovery tank 124. The access opening is covered by access opening lid 130 which is attached to top 108.

A number of fixtures are also seen in the rear wall 114 of upper frame structure 14. Thru-hull fitting 136 extends through the upper portion of rear wall 114 into recovery tank 124. Baffle 138 is attached to the top of recovery tank 124. Vacuum hose coupling 140 is attached to the external portion of thru-hull fitting 136. Vacuum hose 142 connects with vacuum hose coupling 140 and extends downwardly through chasis 18 where it connects with a vacuum hose coupling on vacuum head 96. It is appreciated that vacuum hose 142 communicatively connects with vacuum head 96 and recovery tank 124. Drain valve 144 is also fitted into rear wall 114 and extends through the same into the lower portion of recovery tank 124.

It is further seen that a side port 148 is fitted into the lower portion of rear wall 114 and extends through the same into mechanical compartment 126. Side port 148 serves as a hook-up for an auxillary wand 220 supplied with carpet cleaning machine 10 and shown in FIG. 1.

Also, the flexible shaft 212 and knob 214 which form part of the vacuum head lift mechanism 200 extend from the rear wall 114 of carpet cleaning machine 10.

Figure 3:
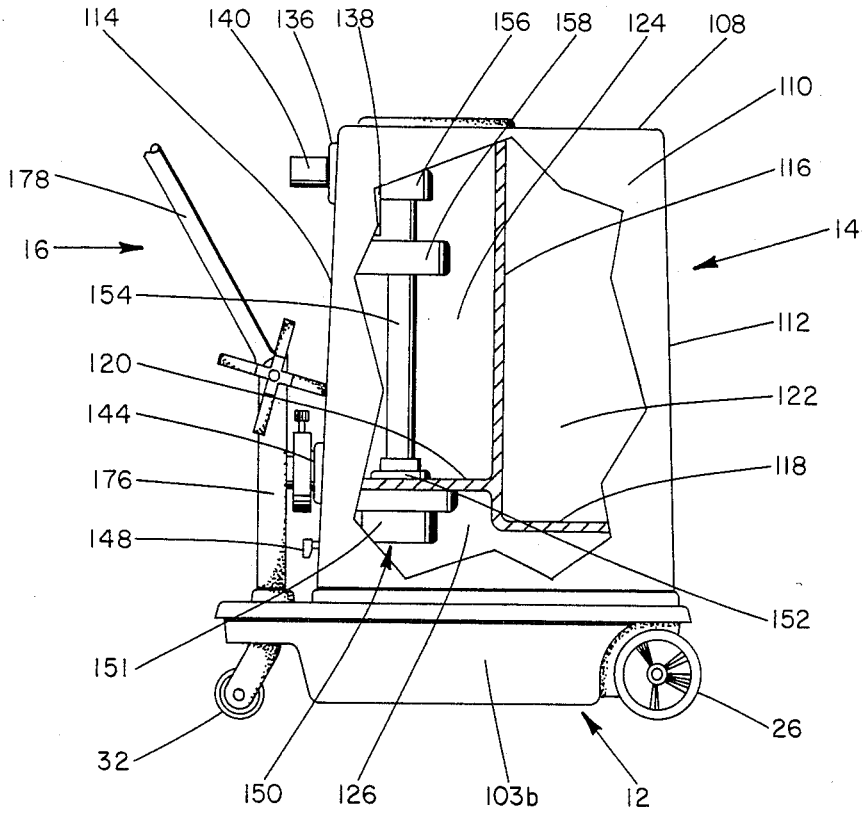
FIG. 3 is a side view of the carpet cleaning machine with a partial cutaway of the upper frame structure of the same.

Viewing upper frame structure 14 internally it is seen that a vacuum assembly indicated generally by the numeral 150 is disposed therein (See FIG. 3). Vacuum assembly 150 includes a blower 151 having an exhaust 151*b* and which is disposed within mechanical compartment 126. Standpipe flange 152 is attached to the opposite side of interior wall 118 and is disposed within recovery tank 124. Standpipe flange 152 supports a standpipe 154 which extends upwardly inside recovery tank 124. A float cap 156 is secured about the upper end of standpipe 154. The lower end of standpipe 154 extends through an opening in bottom 120 where it connects with an intake of blower 104. Float 158 is fitted about standpipe 154 and is free to move up and down on standpipe 154 as the fluid level changes in recovery tank 124.

Figure 5:
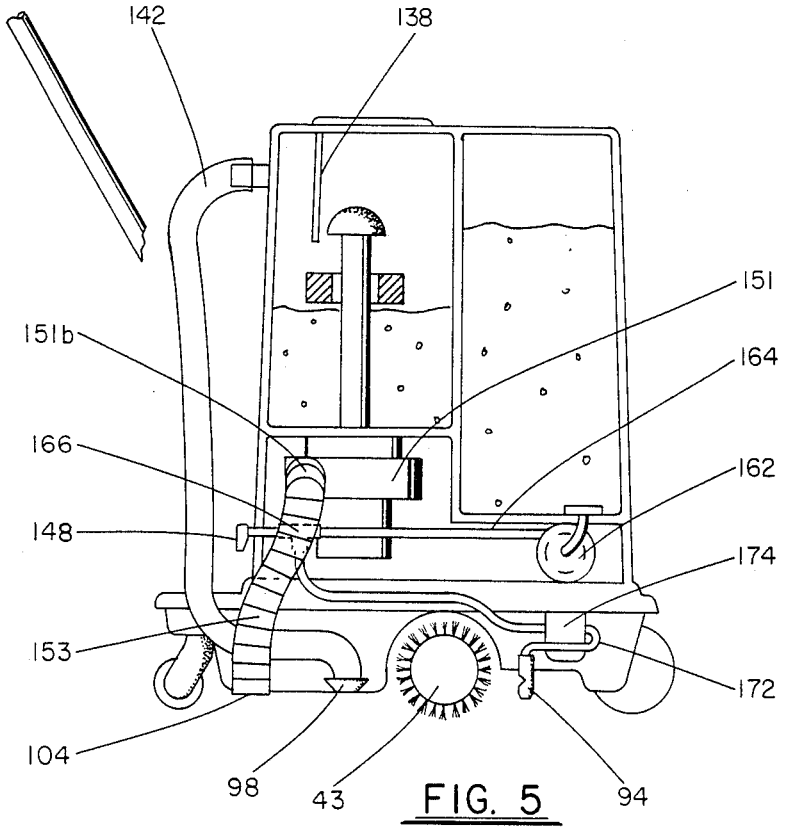
FIG. 5 is a schematic illustration of the carpet cleaning machine.

A solution supply system is also disposed within upper frame structure 14 (See FIG. 5). Solution supply system includes a variable flow pump 162 which is communicatively connected to supply tank 122. A solution supply line 164 connects pump 162 with a pipe-tee 166. Pipe-tee 166 in turn is connected with side port 148 and with main jets 94 by main line 172. A solenoid 174 is communicatively connected in main line 172 between tee 166 and main jets 94. Solenoid 174 acts as a cut-off valve and is operatively connected with push button switch 188 on control panel 182.

Finally, viewing handle assembly 16 in more detail it is seen that the same includes handle bar mounts 176 which are attached to chasis 18 behind upper frame structure 14. Handle bar 178 is pivotly mounted to handle bar mounts 176.

A cord flip 179 is pivotally attached to handle bar 178. Cord flip 179 includes a spiral 179*a* which is designed to receive and hold an extension cord. By swinging cord flip 179 with an extension cord situated therein from one side of carpet cleaning machine 10 to the other, the extension cord can be continuously held in a position which is out of the way of carpet cleaning machine 10 while the same is being used.

Figure 4:
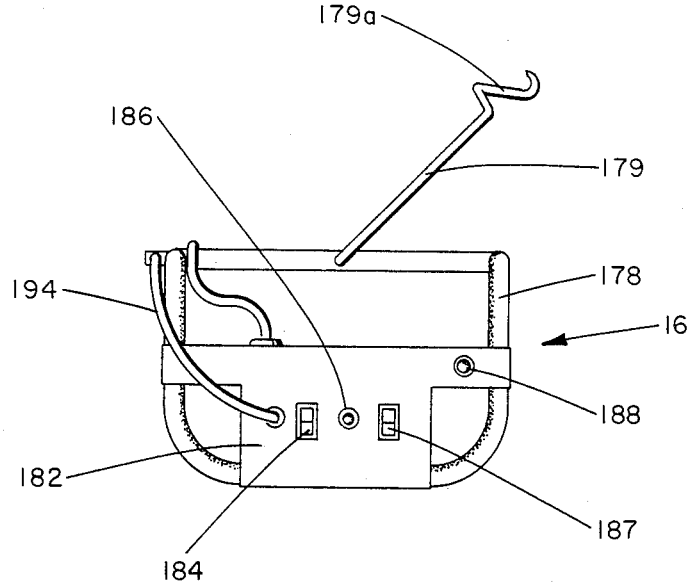
FIG. 4 is a fragmentary view of the handle assembly and control panel of the carpet cleaning machine.

Handle assembly 16 also includes a control panel 182 which is mounted on the upper end of handle bar 178 (See FIG. 4). Control panel 182 includes a power switch 184, a flow control knob 186, an enabling switch 187, and a push button switch 188 which are wired in a parallel circuit. Power switch 184 turns blower 151 on and off. Flow control knob 186 turns on pump 162 and adjusts the speed of variable flow pump 162. Enabling switch 187 has no apparent effect but in fact provides power to push button switch 188 which is in series with enabling switch 187. Push button switch 188 controls electric motor 84 and opens solenoid 174 which are wired in series with a fuse (not shown).

In operation, the supply tank 122 is filled with cleaning solution. The carpet cleaning machine is then pushed to a starting point on the carpet. An extension cord is plugged into power cord 194 and situated within cord flip 179. The other end of the extension cord is plugged into a 115 V grounded outlet. The pump is started by turning flow control knob 186 to the desired setting. The blower is started by flipping power switch 184. Next, the enabling switch 187 is turned on to provide power to push button switch 188. Then lower vacuum head 96 by letting flexible shaft 212 slide into opening 216 on rear wall 114 of upper frame structure 14. Then, press push button switch 188 as the carpet cleaning machine 10 is pushed across the carpet at a slow walking pace.

The push button switch 188 opens solenoid 174 allowing cleaning solution to flow from supply tank 122 to jets 170. Jets 94 spray cleaning solution onto brush 43 which is also been set into a rotating motion by push button switch 188. Brush 43 transfers the cleaning solution into the carpet. As the machine is propelled forward the vacuum head 96 floats over the carpet effectively picking up a combined mixture of air and cleaning solution. The mixture is then pulled upwardly through vacuum hose 142 into recovery tank 124. Baffle 138 causes the solution to fall out while the air is sucked up under float cap 156 into standpipe 154 where the air is directed to blower 151. Once in the blower the air is heated and blown out exhaust 151*b*. A blower hose 153 directs the heated air through outlet 104 and onto the underlying carpet drying the same as the machine continues to be propelled forward. Thus the carpet cleaning machine 10 can clean and dry a carpet in only one pass.

Since carpet cleaning machine 10 is unable to reach corners, etc., it is equipped with an auxillary wand 220. A solution line on auxillary wand connects to side port 148. A vacuum hose on auxillary want connects with coupling 140 on thru-hull fitting 136. When side port is opened the cleaning solution is directed through auxillary wand 220 onto the underlying carpet. Auxillary wand 220 then vacuums the cleaning solution which passes into recovery tank 124. Auxillary wand 220, therefore, makes carpet cleaning machine 10 effective for cleaning an entire carpeted area without having to resort to other devices to complete parts of the job.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A self-contained industrial type carpet cleaning and maintenance machine for cleaning low pile carpets in a single pass as the machine is propelled over the carpet in a selected direction comprising: a mobile frame structure having a cleaning undercarriage; a supply tank secured within said mobile frame structure above said undercarriage wherein said supply tank acts as a reservoir for a carpet cleaning solution; a cylindrical brush operatively secured to said undercarriage such that said brush is in contact with said carpet; drive means for rotating said brush; a plurality of jets operatively secured to said undercarriage adjacent to and directed towards said cylindrical brush; a pump communicatively connected between said supply tank and said jets for directing cleaning solution from said supply tank through said jets onto said cylindrical brush which in turn transfers the cleaning solution to the carpet as the carpet cleaning machine is propelled over the same; vacuum means associated with said carpet cleaning machine for removing the cleaning solution applied to the carpet by said cylindrical brush, said vacuum means including a vacuum head secured to said undercarriage adjacent to and rearwardly of said cylindrical brush so as to engage the carpet as said carpet cleaning machine is propelled thereover, and a blower communicatively connected to said vacuum head for generating a system of moving air and inducing the same into said vacuum head wherein said moving air tends to lift the cleaning solution from the carpet and transfer the same into said vacuum head, said vacuum means further including a recovery tank secured with said mobile frame structure above said undercarriage and communicatively connected between said vacuum head and said blower for receving the system of moving air passing from said vacuum head and for holding cleaning solution separated from the system of moving air as the same passes therethrough to said blower; mounting means for movably securing said vacuum head to said undercarriage such that said vacuum heat can freely move upwardly and downwardly independently of and relative to said undercarriage in response to the undulations of the underlying carpet; and carpet drying means for drying the carpet after the cleaning solution has been removed by said vacuum head, said carpet drying means including an outlet secured to said undercarriage adjacent to and rearwardly of said vacuum head and means for heating the system of moving air after the same has passed through said recovery tank and directing the heated air through said outlet onto the carpet for drying the same as said carpet cleaning machine is propelled over an area of the carpet such that the carpet cleaning machine sequentially applies a cleaning solution to the carpet, removes the cleaning solution and associated dirt and debris from the carpet, and dries the carpet in a single pass as the machine is propelled in the selected direction.

2. The carpet cleaning machine of claim 1 wherein said mounting means includes a pair of parallel bar linkages which allows said vacuum head to freely move upwardly and downwardly independently of and relative to said undercarriage in response to undulations in the underlying carpet.

3. The carpet cleaning machine of claim 2 wherein each of said linkages has sufficient slop therein to allow said vacuum head to cant from side to side in response to undulations in the underlying carpet.

4. The carpet cleaning machine of claim 1 further comprising a vacuum head lift mechanism including a cam surface formed on the underside of said vacuum head, a cam movably mounted adjacent to said cam surface and movable between a first position and a second lifting position such that said cam lifts said vacuum head to an elevated position relative to said undercarriage by pushing upwardly on said cam surface as said cam moves from said first position to said second lifting position; and means for moving said cam between said first position and said second lifting position.

5. The carpet cleaning machine of claim 1 wherein said drive means includes an electric motor for driving said brush and impact starter means operatively connected between said electric motor and said brush for sequentially separating the motor starting load from the brush starting load.

6. The carpet cleaning machine of claim 5 wherein said drive means further includes a jack shaft operatively interconnected between said electric motor and said brush and wherein said impact starter means includes a pair of drive sheaves one of which is rotatively journaled about said jack shaft so as to rotate freely about the same and one of which is keyed to said jack shaft so as to rotate with the jack shaft and wherein one drive sheave includes a means defining an opening therein by a surrounding wall structure and the other drive sheave includes a stud extending outwardly therefrom and through the opening in the first drive sheave so that said drive sheaves are mated in a manner which allows said freely rotating drive sheave to rotate a part of a turn prior to the stud of one drive sheave engaging the surrounding wall structure of the opening in the other drive sheave.

7. The carpet cleaning machine of claim 1 further comprising means for reversing the rotation of said brush.

8. The carpet cleaning machine of claim 7 wherein said drive means includes a drive block having a pair of pin members and wherein said brush includes a thick wall plastic tube having a pair of holes drilled into each end of said tube such that either end of said tube can be mounted on said drive block by inserting said pin members into said holes in the end of said plastic tube.

9. The carpet cleaning device of claim 1 wherein said vacuum head includes an elongated manifold having an elongated slot, said manifold being aligned with the underlying carpet so that said elongated slot is directly facing the carpet.

10. The carpet cleaning machine of claim 1 wherein the carpet cleaning machine is designed to be propelled over an underlying carpet at a normal ground speed and wherein said rotating cylindrical brush is designed to have a surface velocity greater than the normal ground speed of said carpet cleaning machine thereby helping to propel the carpet cleaning machine over said underlying carpet.

11. The carpet cleaning machine of claim 10 wherein said ground speed of said carpet cleaning machine is from two to four feet per second and wherein said surface velocity of said rotating cylindrical brush is approximately six feet per second.

12. The carpet cleaning machine of claim 1 further comprising a cord flip device operatively secured to said mobile frame structure for engaging and disposing an electrical cord situated therein on either side of said carpet cleaning machine wherein said cord flip device can be flipped from one side of said machine to the other side carrying with said cord flip device the electrical cord situated therein.

13. The carpet cleaning machine of claim 1 further comprising a remote wand which can be operatively connected to said carpet cleaning machine for cleaning small carpeted areas which are inaccessable to said carpet cleaning machine.

14. A method of cleaning and maintaining large areas of carpet in a single pass using a fully integrated carpet cleaning machine comprising the steps of:

A. rotating an elongated cylindrical brush on said carpet cleaning machine and engaging said brush with an underlying carpet;

B. moving said carpet cleaning machine forwardly over the underlying carpet;

C. applying a cleaning solution to the underlying carpet as said carpet cleaning machine is moved forwardly across the same;

D. agitating the cleaning solution in the carpet by continuing to rotate said cylindrical brush as said carpet cleaning machine is moved forwardly across the underlying carpet;

E. floating a vacuum head secured to said carpet cleaning machine over said underlying carpet rearwardly of said cylindrical brush so said vacuum head moves upwardly and downwardly in response to the undulation of the underlying carpet as said carpet cleaning machine is moved forwardly over said underlying carpet;

F. vacuuming the cleaning solution from said underlying carpet by passing a system of moving air over said carpet and into said vacuum head and effectively lifting the cleaning solution from the underlying carpet as said carpet cleaning machine is moved forwardly over said underlying carpet;

G. separating said cleaning solution from said system of moving air by passing the system of moving air through a recovery tank secured within said carpet cleaning machine which captures and holds the cleaning solution while the system of moving air continues to move; and H. drying the carpet as the carpet cleaning machine is moved forwardly across said underlying carpet and after the cleaning solution is removed therefrom by directing the system of moving air through an outlet secured to said carpet cleaning machine adjacent to and behind said vacuum head and onto the underlying carpet such that the carpet cleaning machine sequentially applies a cleaning solution to the carpet, removes the cleaning solution and associated dirt and debris from the carpet, and dries the carpet in a single pass as the machine is propelled in the selected direction.

15. The method of claim 14 wherein the step of applying a cleaning solution to the carpet includes spraying the cleaning solution onto said brush which actually transfers the cleaning solution to said carpet as said brush continues to rotate.

16. The method of claim 14 further comprising the step of heating the system of moving air after the cleaning solution has been separated therefrom and prior to directing said system of moving air onto said carpet thereby imparting to the system of moving air a greater drying capacity.

17. The method of cleaning and maintaining large areas of carpet of claim 14 comprising the additional steps of:

A. attaching an auxiliary wand to said carpet cleaning machine;

B. directing cleaning solution through said auxiliary wand onto areas of the underlying carpet which are inaccessible to said carpet cleaning machine; and C. vacuuming the cleaning solution from the underlying carpet by passing a system of moving air over the same into said auxiliary wand and effectively lifting the cleaning solution from the underlying carpet.

18. The method of cleaning and maintaining large areas of carpet of claim 14 comprising the additional step of periodically reversing said elongated cylindrical brush.

19. A self contained industrial type carpet cleaning and maintenance machine for cleaning carpets in a single pass as the machine is propelled over the carpet in a selected direction comprising: a mobile frame structure having a cleaning undercarriage; a supply tank secured on board and within said mobile frame structure about said undercarriage wherein said supply tank acts as a reservoir for a carpet cleaning solution; means associated with said carpet cleaning machine for directing the carpet cleaning solution from said supply tank onto the underlying carpet; brush means associated with said carpet cleaning machine for agitating the carpet cleaning solution on the underlying carpet as said carpet cleaning machine is propelled over the same; vacuum means associated with said carpet cleaning machine for removing carpet cleaning solution from the underlying carpet, said vacuum means including a vacuum head secured to said undercarriage adjacent to and rearwardly of said brush means and a blower communicatively connected to said vacuum head for generating a system of moving air and inducing the same into said vacuum head wherein said moving air tends to lift the cleaning solution from the carpet and transfer the same into said vacuum head, said vacuum means further including a recovery tank disposed on board and within said mobile frame structure above said undercarriage and communicatively connected between said vacuum head and said blower for receiving the system of moving air from said vacuum head and for separating and retaining the cleaning solution contained therein as the system of moving air passes therethrough to said blower; mounting means for movably securing said vacuum head to said undercarriage such that said vacuum head freely moves upwardly and downwardly independently of and relative to said undercarriage in response to undulations in the underlying carpet; and carpet drying means including a drying outlet secured to said undercarriage adjacent to and rearwardly of said vacuum head wherein said drying outlet is communicatively connected to said blower so that the system of moving air generated by said blower passes through the same to said drying outlet where said system of moving air is directed onto the underlying carpet for drying the same.

20. An industrial type carpet cleaning and maintenance machine for cleaning low pile carpets as the machine is propelled over the same comprising: a mobile frame structure having a cleaning undercarriage; a supply tank mounted on said mobile frame structure for holding a carpet cleaning solution; means associated with said carpet cleaning machine for directing carpet cleaning solution from the supply tank onto the underlying carpet; brush means secured to said undercarriage for agitating the carpet cleaning solution on the underlying carpet as said carpet cleaning machine is propelled over the same; drive means operatively associated with said brush means for driving the same, said drive means including an electric motor and impact starter means operatively connected between said electric motor and said brush for sequentially separating the brush starter load from the electric motor starting load; vacuum means associated with said carpet cleaning machine for removing the carpet cleaning solution from the underlying carpet, said vacuum means including a vacuum head secured to said undercarriage and a blower communicatively connected to said vacuum head for generating a system of moving air and inducing the same into said vacuum head wherein said moving air tends to lift the cleaning solution from the carpet and transfer the same into said vacuum head, said vacuum head means further including a recovery tank mounted on said frame mobile frame structure and communicatively connected between said vacuum head and said blower for receiving the system of moving air from said vacuum head and for separating and retaining the cleaning solution contained therein as the system of moving air passes therethrough to the blower; and carpet drying means including a drying outlet secured to said undercarriage and communicatively connected to said blower so that the system of moving air generated by said blower passes through the same to said dry outlet where said system of moving air is directed onto the underlying carpet for drying the same.

21. The carpet cleaning machine of claim 20 wherein said drive means further includes a jack shaft operatively interconnected between said electric motor and said brush and wherein said impact starter means includes a pair of drive sheaves one of which is rotatively journaled about said jack shaft so as to rotate freely about the same and one of which is keyed to said jack shaft so as to rotate with the jack shaft and wherein one drive sheave includes an opening therein defined by a surrounding wall structure and the other drive sheave includes a stud extending outwardly therefrom and through the opening in the other drive sheave so that said drive sheaves are mated in a manner which allows said freely rotating drive sheave to rotate a part of a turn prior to the stud of one drive sheave engaging the surrounding wall structure of the opening in the other drive sheave.

22. The carpet cleaning machine of claim 20 wherein said brush means is a rotating cylindrical brush.

23. The carpet cleaning machine of claim 22 wherein said means for directing the carpet cleaning solution from said supply tank onto said carpet includes a plurality of jets secured to said undercarriage and directed towards said rotating brush whereby cleaning solution is sprayed onto said brush which transfers the cleaning solution to the carpet.

24. The carpet cleaning machine of claim 20 including means for movably mounting said vacuum head for up and down movement independent of and relatively to said undercarriage such that said vacuum head may freely move up and down in response to undulations in the carpeting being traversed.

* * * * *